US006352171B2

(12) United States Patent
Leboucher

(10) Patent No.: US 6,352,171 B2
(45) **Date of Patent: *Mar. 5, 2002**

(54) INTEGRAL INJECTED CONTAINER AND TOP

(75) Inventor: Xavier Leboucher, Clichy (FR)

(73) Assignee: VG Emballage, Aubervilliers (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/320,647

(22) Filed: May 27, 1999

(30) Foreign Application Priority Data

May 27, 1998 (FR) ..... 98/06662
Nov. 12, 1998 (FR) ..... 98/14189

(51) Int. Cl.[7] ..... B65D 43/16

(52) U.S. Cl. ..... 220/838; 132/293; 206/581; 220/361; 220/839

(58) Field of Search ..... 220/361, 364, 220/89.4, 839, 254, 259, 837, 838; 206/1.7, 581, 1.8, 1.9, 5.1, 6; 132/293; 215/235; 53/468, 478, 471; 438/63

(56) References Cited

U.S. PATENT DOCUMENTS 557,461 A * 3/1896 Welander ..... 220/839
1,667,919 A * 5/1928 Younghusband ..... 132/293
1,852,455 A * 4/1932 Friedman ..... 132/293
1,969,724 A * 8/1934 Brooks ..... 220/346
2,492,883 A * 12/1949 O'Neil ..... 220/364
2,852,054 A * 9/1958 Motley ..... 220/834
3,037,616 A * 6/1962 Phipps, III ..... 206/5.1
3,043,354 A * 7/1962 Frizgerald ..... 220/839 X
3,050,914 A * 8/1962 Morgan, Jr. ..... 53/468
3,186,540 A * 6/1965 Breger ..... 206/5.1
3,335,897 A * 8/1967 Castro ..... 220/363 X
3,442,414 A * 5/1969 Pelli ..... 220/839 X
3,489,266 A * 1/1970 Miller ..... 206/524.5
3,592,353 A * 7/1971 Bowen ..... 220/361 X
3,628,215 A * 12/1971 Everburg ..... 220/838
3,629,901 A * 12/1971 Wolf ..... 220/838
3,661,248 A * 5/1972 Isen et al. ..... 206/5.1 X
3,911,936 A * 10/1975 Kingsford ..... 132/316
3,943,682 A * 3/1976 Rausing ..... 53/468
4,231,211 A * 11/1980 Strampfer et al. ..... 53/468
4,244,470 A * 1/1981 Burnham ..... 206/525
4,250,997 A * 2/1981 Bodenmann et al. ..... 206/528
4,403,712 A * 9/1983 Weisnger ..... 220/838
4,508,235 A * 4/1985 Steele et al. ..... 220/254 X
4,543,882 A * 10/1985 Ryder et al. ..... 206/5.1 X
4,573,600 A * 3/1986 Dubach ..... 220/383
5,037,000 A * 8/1991 Selame ..... 220/839
5,139,165 A * 8/1992 Hara ..... 220/835
5,433,314 A * 7/1995 Lin ..... 206/5.1
5,435,456 A * 7/1995 Dubach ..... 220/383
5,516,495 A * 5/1996 Kutner et al. ..... 206/5.1 X
5,573,139 A * 11/1996 Yeh ..... 220/361 X
5,860,550 A * 1/1999 Miller et al. ..... 220/839

FOREIGN PATENT DOCUMENTS

GB 2275648 * 9/1994

* cited by examiner

*Primary Examiner*—Stephen P. Garbe
*Assistant Examiner*—Joseph C. Merek
(74) *Attorney, Agent, or Firm*—Oblon, Spivak, McClelland, Maier & Neustadt, P.C.

(57) ABSTRACT

The vessel (1) includes a container (2), a top (3) and a flexible hinge (4) connecting the container (2) with the top (3), the flexible hinge (4) being made of the same material as the container and top. The container may hold cosmetic, flagrance or pharmaceutical products, and/or to contain a cream and/or a sample quantity of a product.

5 Claims, 1 Drawing Sheet

INTEGRAL INJECTED CONTAINER AND TOP

BACKGROUND OF THE INVENTION

The invention concerns the packaging of products such as creams manufactured for the cosmetic, pharmaceutical, fragrance and even food industries. In particular, the invention targets the packaging of small quantities, 15 ml at most, which are likely to be used as demonstration or other types of supples. Nevertheless, the invention may be adapted for packaging greater quantities, as well as for powdered or fairly viscous fluid products.

SUMMARY OF THE INVENTION

In the type of packaging addressed in the invention, the determining factors are rapid and low cost manufacturing the packaging, and satisfactory, if not perfectly airtight, insulation of the contents in relation to the ambient atmosphere. These goals are met in a simple fashion using the packaging means of the invention, which has as its object a vessel including a container, a top and a flexible hinge connecting the container and the top, wherein the container, the top and the flexible hinge are made of the same material.

This vessel may be made using quick, simple and economical processes as explained below. Perfect airtightness may be guaranteed in certain modes of implementation. Numerous forms of the hinge, made of the same material as the container and the top, are compatible with the invention, such as a flexible tab, for example.

Preferably, the flexible hinge is a spring-action hinge. Through this action, the hinge moves the top into either the open or closed position from an intermediary unstable equilibrium position. Such a flexible hinge, which is advantageous because it does not include any large protruding parts, makes it possible to use traditional filling machines and is described in relation to a dispensing closure in French patent B1-2 498 240, which is herein incorporated by reference. Such a dispensing closure, which is widely used for food and cosmetic products, especially for shampoo, is commonly of a roughly cylindrical geometry; it is screwed by its lower open part onto the neck of a bottle and its upper part is closed by a top connected to it by a hinge. The dispensing closure also includes a transverse wall having a through opening permits a controlled flow of the contained product under the effect, for example, of pressure exerted on the sides of the bottle.

The vessel of the invention advantageously includes means for locking the closed position of the top, these means may consist of a part of the container which forms a relief with respect to the top, allowing the container to fit into a concavity of the top, which of course has a position and shape corresponding to those of the relief. The effect produced is a snap fit of the top onto the container.

Other relief forms and/or concavity forms, such as ring-shaped forms, may also be used at the edge of the container and/or the top in order to guarantee the airtightness of the vessel of the invention, while also participating, if necessary, in locking the top in closed position as described above.

The preferred material for constituting the vessel of the invention is an injectable plastic material. The latter includes a material molded by reaction injection molding (R.I.M.); this technique involves injection of liquid polycondensation reagents into a mold. The injectable plastic material may also include a thermoplastic material molded using traditional injection. Preferably, this material consists of a non-styrene polyolefin or of a mixture of such polyolefins, selected from among a polypropylene, a propylene copolymer or a polyethelene.

According to a feature of the invention, the outer surface of the vessel, that is, its visible surface when the top is in closed position, defines a concavity at the joint between the container and the top. A user can initiate the opening of the top by pressing the edges of the concavity. In this variation, one of said edges necessarily belongs to the container and the other belongs to the top, such that the container and the top may be separated from one another.

In an especially interesting mode of implementation, the top has a traversing hole. It should be noted that in the absence of this characteristic, filling the vessel requires the prior opening of the top. When the top is in an open position, it is more difficult to position an optional printed motif on the periphery of the vessel using an offset-type technique; moreover, when the vessels are passed into vibrating feeders, if the tops are open some of the vessels may push each other out of the feeders, which does not occur when the top is in closed position, thereby making possible a more consistent and homogeneous dispensing of vessels in the feeders.

The vessels are filled via the traversing hole in the top, then the traversing hole is sealed by a casting corresponding in shape to that of the traversing hole. This casting may be, but is not necessarily, constituted in the same manner as the other parts of the vessel. This sealing may be done by pressing the casting onto the edges of the traversing hole or by fitting the casting onto these edges and applying an adhesive film covering the upper surface of the casting and the top, or the like.

Another object of the invention is an injection manufacturing process of the vessel described above. This process is simple, quick and economical. It also allows vessels of different capacities to be manufactured by modifying only one of the two half-molds, or even by removing or adding removable parts to this half-mold.

Other objects of the invention consist in using the vessel described above to contain a cosmetic, fragrance or pharmaceutical product; to contain a product having a cream consistency; or to contain a product sample in a quantity ranging from 1 to 25 ml, preferably between 2 and 15 ml.

BRIEF DESCRIPTION OF THE DRAWINGS

Other characteristics of the invention will appear in the description following the annexed drawings, wherein.

DETAILED DESCRIPTION OF THE PREFERRED EMBODIMENTS

With reference to these three figures, a vessel 1 is produced from a known injection process using standard polypropylene.

It includes a container 2 and a top 3 connected to container 2 by means of a flexible hinge 4 linking container 2 to top 3. The container 2, the top 3 and the flexible hinge 4 are composed of the same material, for example they constitute a continuous body formed of injected polypropylene.

Figure 1A:
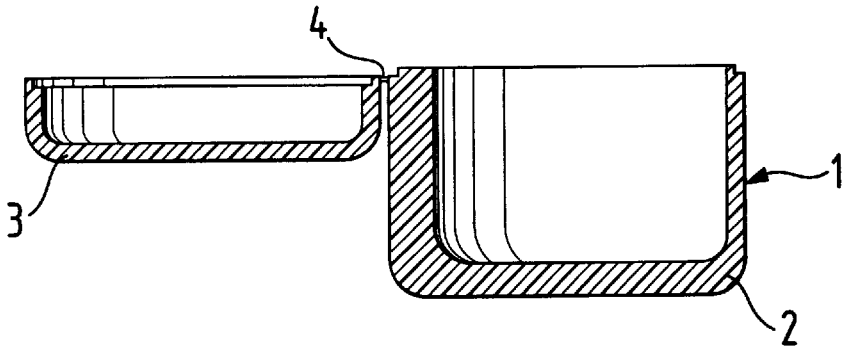
FIG. 1*a* is a side section view of a first vessel in accordance with the invention, with the top in open position.
Figure 1B:
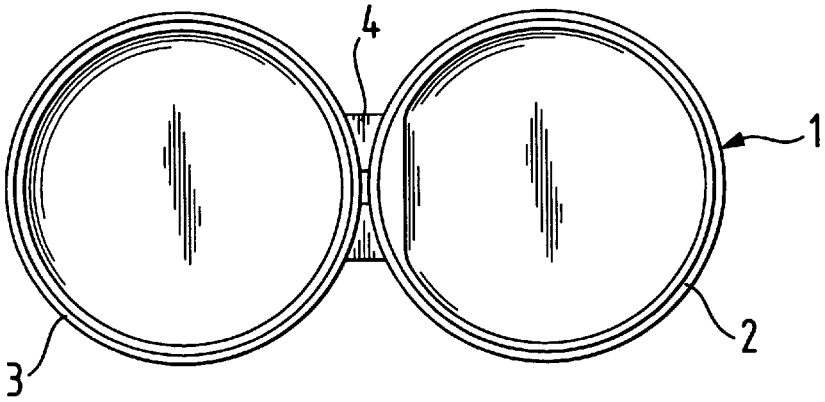
FIG. 1*b* is a top view of this vessel.

FIG. 1*b* illustrates a longitudinal plane of symmetry (transverse to the plane of this figure). The flexible hinge 4 is a spring-action hinge. It is constituted by a median part in whose continuity are located, on either side of the above-mentioned plane of symmetry, (polypropylene) trapezoidal or quasi-triangular sheets, as described in French patent B1–2 498 240.

Figure 2:
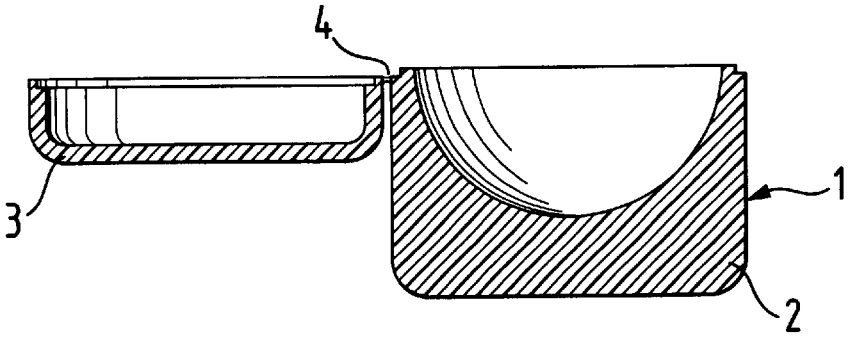
FIG. 2 is a side section view of a second embodiment of a vessel according to the invention, with the top in the position indicated above.

The vessels represented in FIGS. 1*a* and 2, respectively, are of 5 ml and 3 ml capacities. They may be manufactured by using a single first half-mold and two different and interchangeable second half-molds, or by using a single mold and interchangeable pins.

In one mode of implementation, the top 3 includes a traversing hole 3*b* sealed by a correspondingly shaped casting as shown in phantom lines. The hole may be of circular shape, centered on the axis of symmetry of the top 3 and have an area which corresponds to 10 to 50% or even up to 70%, of the transverse section of the vessel. The casting may be, but is not necessarily, constituted in the same manner as the other parts of the vessel. Sealing may be done by pressing the casting onto the edges of the traversing hole or by fitting the casting onto these edges and applying an adhesive film covering the upper surface of the casting and the top, or the like.

A relief or groove 2*a* at the edge of the container forms an inner projection which can snap fit into an internal recess 3*a* of the top to maintain or lock a tight closure of the top. This snap fit can be overcome by the user snapping the top open via the (non-illustrated) concavity.

The invention makes possible a packaging means for numerous products, using a perfectly compatible material such as polypropylene, which may be obtained by a simple, economical and adaptable process.

What is claimed is:

1. A vessel comprising a container, a top and a flexible spring action hinge linking the container and the top, wherein the container, the top, and the flexible hinge are made of the same molded material, said container having substantially cylindrical side wall and an inner surface of the bottom being concave and further comprising:

a filled area in the center of the top, said area extending from an outer surface of the top to an inner surface of the top, the filled area having a size which corresponds to between 10% and 70% of the area of the vessel in transverse section; the filled area comprising a casting, a groove at the edge of the container, forming an inner projection, and an internal recess in the top, wherein said groove and said recess are configured such that said inner projection can snap fit into the recess to maintain a tight closure of the top.

2. The vessel in accordance with claim 1, further comprising means for locking the top in a closed position.

3. The vessel in accordance with claim 1, made of an injectable plastic material.

4. The vessel in accordance with claim 3, made of a non-styrene polyolefin or of a mixture of polyolefins.

5. The vessel in accordance with claim 4, wherein the non-styrene polyolefin is selected from among the group consisting of a polypropylene, a propylene copolymer and a polyethylene.

* * * * *